US006245300B1

(12) United States Patent
Garcia-Mallol

(10) Patent No.: US 6,245,300 B1
(45) Date of Patent: Jun. 12, 2001

(54) HORIZONTAL CYCLONE SEPARATOR FOR A FLUIDIZED BED REACTOR

(75) Inventor: Juan Antonio Garcia-Mallol, Morristown, NJ (US)

(73) Assignee: Foster Wheeler Energy Corporation, Clinton, NJ (US)

( * ) Notice: Subject to any disclaimer, the term of this patent is extended or adjusted under 35 U.S.C. 154(b) by 0 days.

(21) Appl. No.: 08/288,864

(22) Filed: Aug. 11, 1994

(51) Int. Cl.[7] ..... F27B 15/08

(52) U.S. Cl. ..... 422/145; 422/146; 422/147; 55/459.1

(58) Field of Search ..... 422/147, 146, 422/145; 55/459.1

(56) References Cited

U.S. PATENT DOCUMENTS

| | | | | |
|---|---|---|---|---|
| 2,888,096 | * | 5/1959 | Evans | 55/459.1 |
| 4,285,142 | * | 8/1981 | Suzuki et al. | 55/459.1 |
| 4,664,887 | | 5/1987 | Engstrom | 422/147 |
| 4,721,561 | * | 1/1988 | Oetiker et al. | 55/459.1 |
| 4,731,228 | * | 3/1988 | Dewitz et al. | 55/459.1 |
| 4,732,113 | | 3/1988 | Engstrom | 406/173 |
| 4,900,516 | * | 2/1990 | Engstrom et al. | 422/147 |
| 4,961,863 | * | 10/1990 | Van Den Akker et al. | 422/147 |
| 5,171,542 | * | 12/1992 | Sarkomaa | 55/459.1 |
| 5,174,799 | * | 12/1992 | Garcia-Mallol | 55/269 |
| 5,207,805 | * | 5/1993 | Kalen et al. | 55/459.1 |
| 5,226,936 | * | 7/1993 | Garkawe | 55/459.1 |
| 5,269,637 | * | 12/1993 | Gomes, Jr. | 55/459.1 |
| 5,362,379 | * | 11/1994 | Helstrom | 422/147 |

* cited by examiner

*Primary Examiner*—David W. Wu
(74) *Attorney, Agent, or Firm*—Haynes and Boone, LLP

(57) ABSTRACT

A horizontal cyclone separator in which a furnace section and a vortex chamber communicating with the furnace section and having an inlet which extends a fraction of the length of the furnace section receives a mixture of the gaseous products of combustion and solids entrained by the gases. A coaxially disposed tube extends partially into the chamber to allow the separated gases to exit the separator. A ring-shaped solids deflector is disposed on the vertical wall opposite the coaxially disposed tube to prevent solids from bouncing off the rear wall towards the center of the separator and into the path of the separated gas stream. The separated solids fall into an outlet trough formed in a lower portion of the furnace section for returning the solids to the furnace section.

5 Claims, 3 Drawing Sheets

HORIZONTAL CYCLONE SEPARATOR FOR A FLUIDIZED BED REACTOR

FIELD OF THE INVENTION

This invention relates in general to a cyclone separator, and, more particularly, to a horizontal cyclone separator for separating solid particles from gases generated by the combustion of fuel in a fluidized bed reactor, or the like.

BACKGROUND OF THE INVENTION

A typical cyclone separator is usually associated with a fluidized bed reactor and includes a vertically-oriented, cylindrical vortex chamber in which is disposed a central gas outlet pipe for carrying the separated gases upwardly, while the separated solids are returned to the fluidized bed through a funnel-shaped base of the separator via a stardpipe. These vertical cyclone separators are substantial in size and eliminate the possibility of a compact system design which can be modularized and easily transported and erected. For larger reactors, several vertical cyclone separators are often required to provide adequate particle separation, which compound the size problem and, in addition, usually require complicated gas duct arrangements with reduced operating efficiency.

Horizontal cyclone separators characterized by a horizontally-oriented, cylindrical vortex chamber, as disclosed, for example, in U.S. Pat. No. 5,174,799, have been constructed which eliminate many of the above mentioned problems. For example, horizontal cyclone separators may be readily configured within the upper portion of the reactor and integrated with the walls of the reactor making the bulk, weight, and cost much less than conventional separators. Additionally, they can be modularized making them easy to erect. However, many known horizontal cyclone separators have various shortcomings, particularly with regard to their gas-solids inlet which extends substantially the full length of the separator. This extended length causes the separated solids that have collected on the wall past the exit to become re-entrained in the incoming gas-solids stream. Another shortcoming is that the vertical end wall opposite the gas outlet causes the separated solids to bounce off the latter wall and become re-entrained in the separated gas stream.

SUMMARY OF THE INVENTION

It is therefore an object of the present invention to provide a horizontal cyclone separator that minimizes the re-entrainment of the separated solids into the separated gas stream.

It is a further object of the present invention to provide a horizontal cyclone separator having an inlet that extends a fraction of the length of the separator.

It is a still further object of the present invention to provide a horizontal cyclone separator of the above type in which a ring-shaped solids deflector is provided on the vertical end wall opposite a gas outlet to prevent solids from bouncing from the wall into the separated gas stream.

It is a further object of the present invention to provide a horizontal cyclone separator wherein the incoming gas-solids mixture is directed tangentially into a vortex chamber.

Toward the fulfillment of these and other objects, the horizontal cyclone separator of the present invention includes a furnace section and a vortex chamber communicating with the furnace section and having an inlet which extends a fraction of the length of the furnace section and receives a mixture of the gaseous products of combustion and solids entrained by the gases. Once inside the vortex chamber, the solids are separated from the mixture by centrifugal action. A coaxially disposed tube extends partially into the chamber to allow the separated gases to exit the separator. A ring-shaped solids deflector is disposed on the vertical wall opposite the coaxially disposed tube to prevent solids from bouncing off the rear wall towards the center of the separator and into the path of the separated gas stream. The separated solids fall into a trough formed in a lower portion of the furnace section for returning the solids back to the furnace section.

BRIEF DESCRIPTION OF THE DRAWINGS

The above brief description as well as further objects, features, and advantages of the present invention will be more fully appreciated by reference to the following detailed description of presently preferred but nonetheless illustrative embodiments in accordance with the present invention when taken in conjunction with the accompanying drawing in which.

DESCRIPTION OF THE PREFERRED EMBODIMENT

Figure 1:
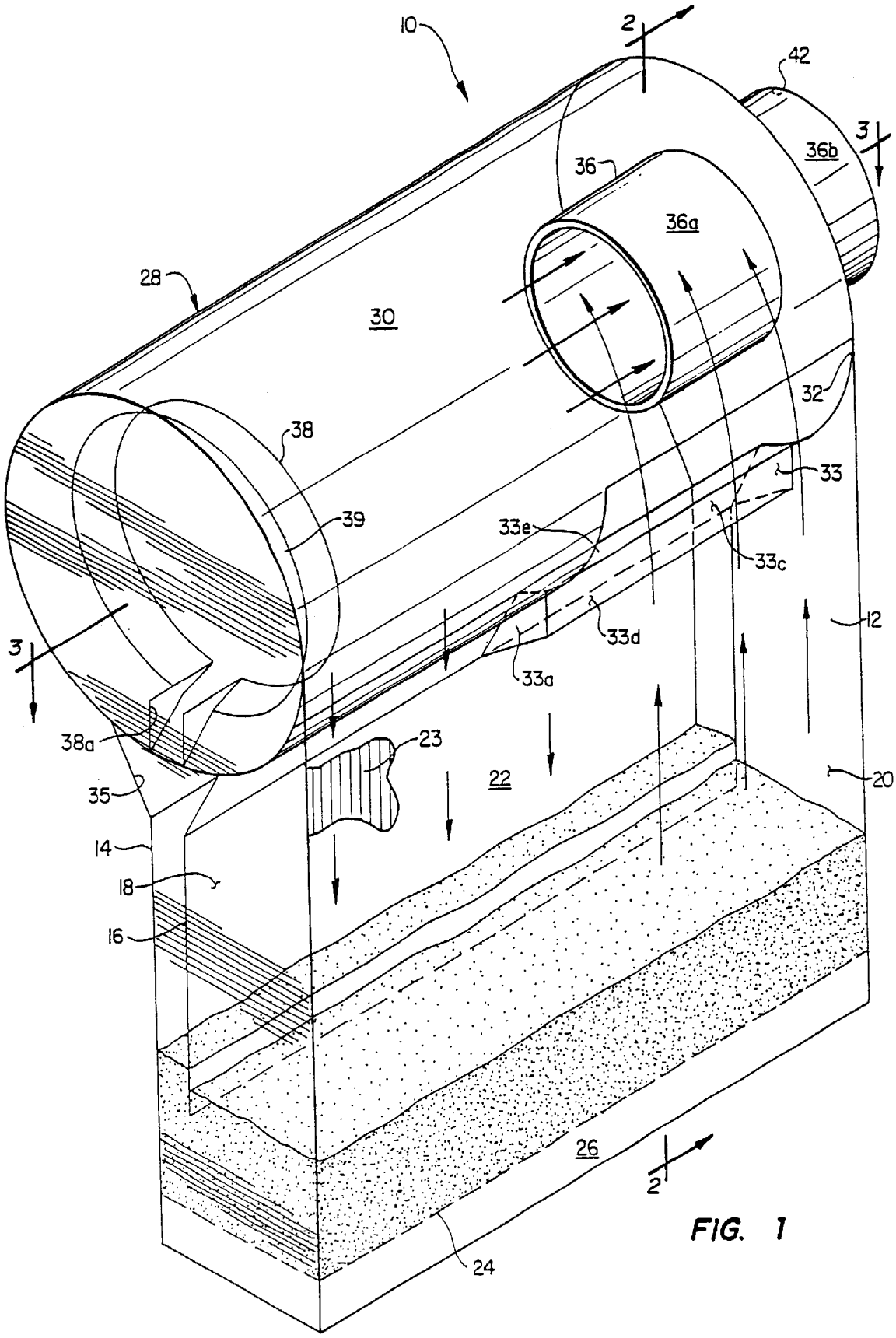
FIG. 1 is a perspective/schematic view of a fluidized bed reactor including the horizontal separator of the present invention.
Figure 2:
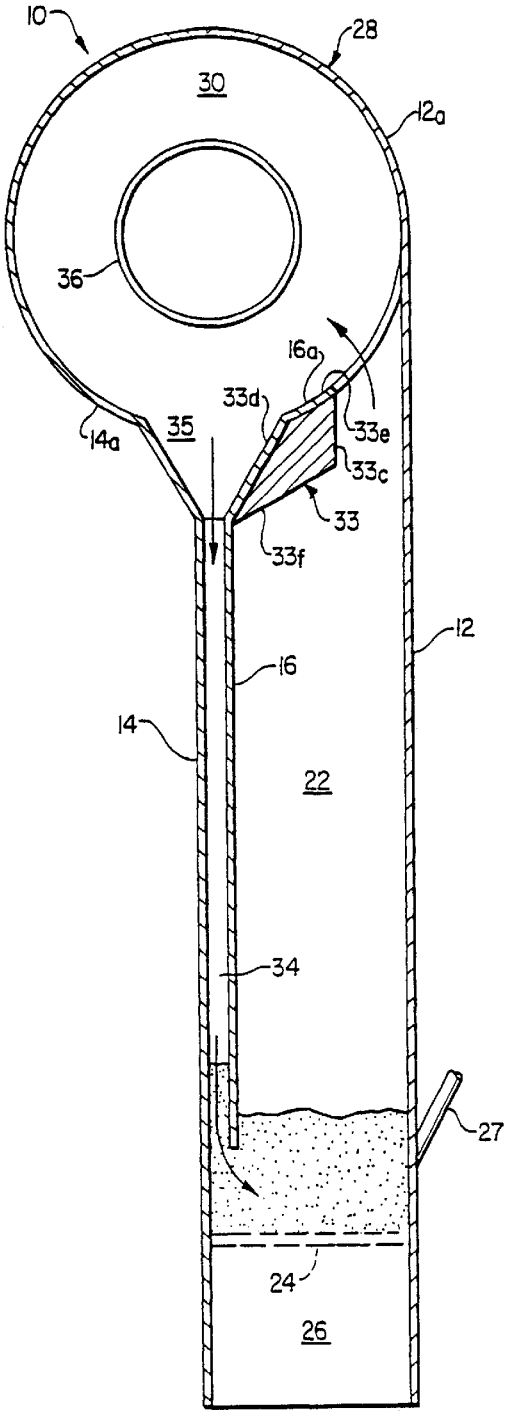
FIG. 2 is a sectional view taken along the line 2—2 of FIG. 1.
Figure 4:
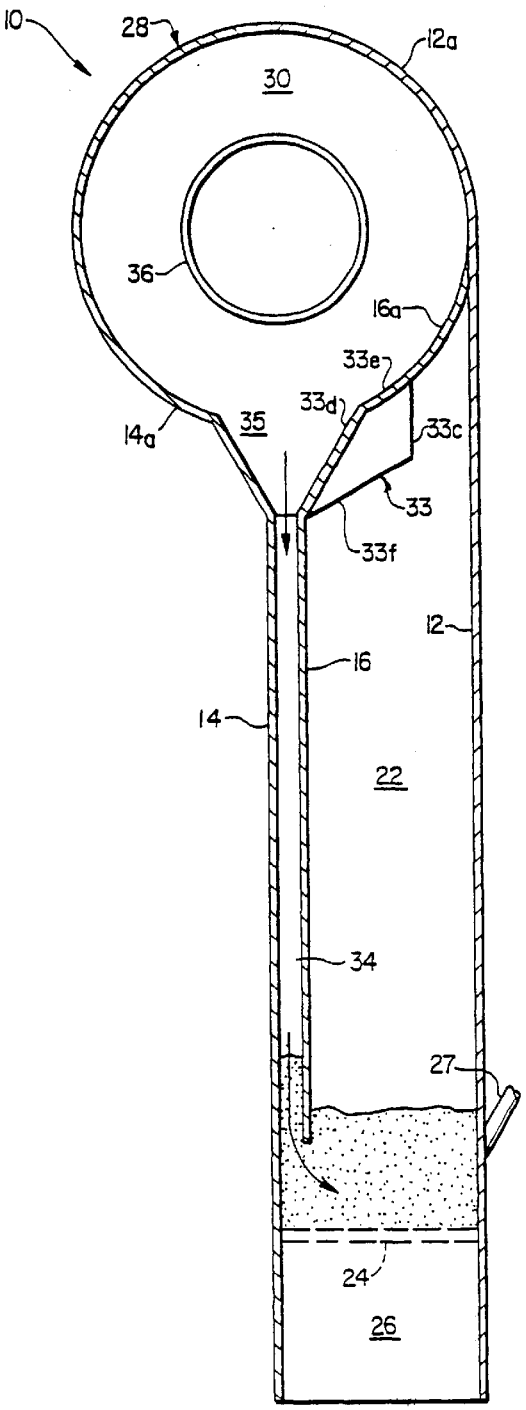
FIG. 4 is a sectional view taken along line 4—4 of FIG. 1.
Figure 3:
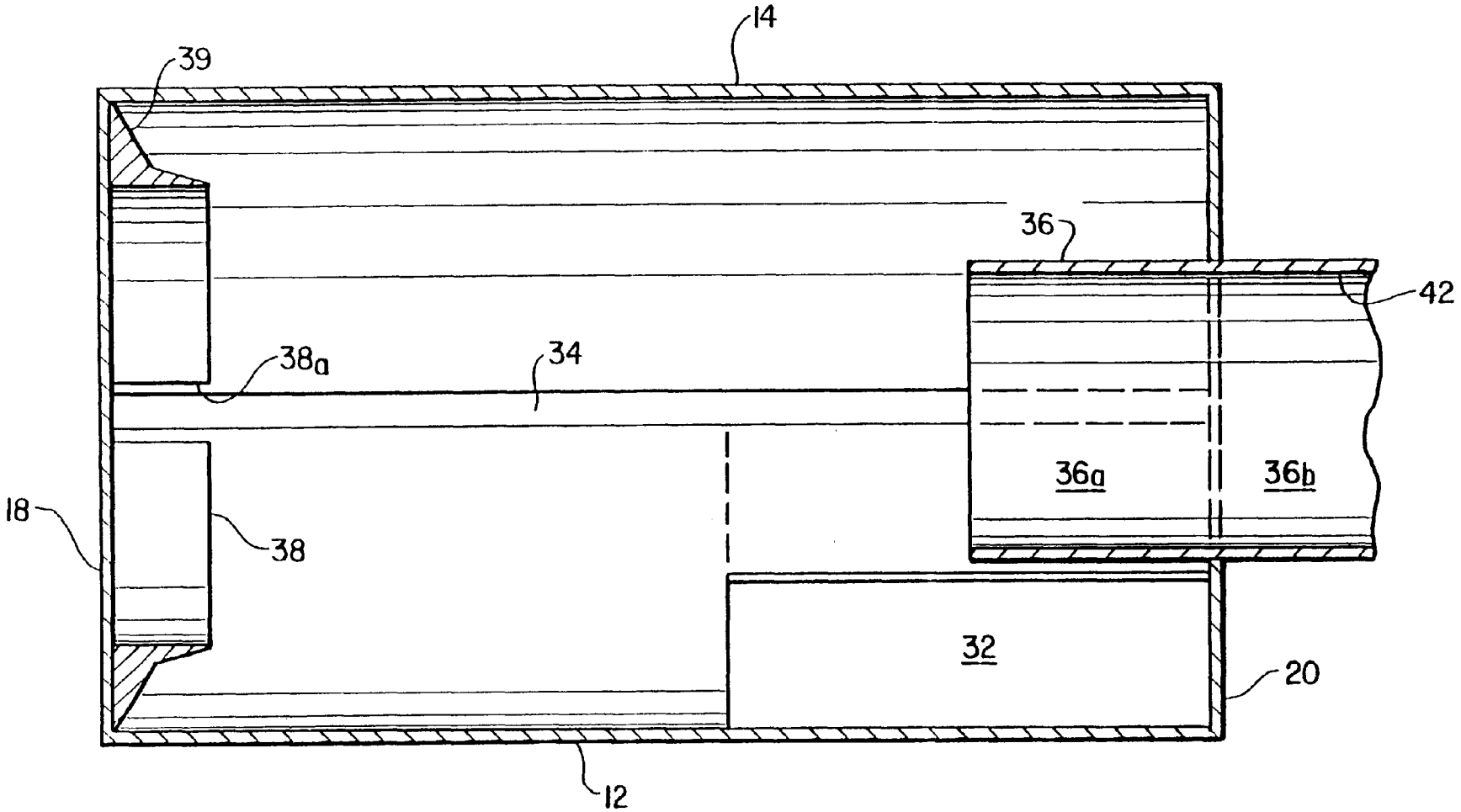
FIG. 3 is a sectional view taken along line 3—3 of FIG. 1.

Referring to FIGS. 1–4 of the drawings, the reference numeral 10 refers, in general, to the fluidized bed reactor of the present invention. The reactor 10 includes a front wall 12, a spaced parallel rear wall 14, and an intermediate partition 16 extending between the walls 12 and 14 in a spaced, parallel relation thereto. As shown in FIG. 1, first and second sidewalls 18 and 20 extend perpendicular to the front wall 12 and the rear wall 14 to form a substantially rectangular vessel. As shown in FIGS. 2 and 4, the upper portions 12*a* and 14*a* of the walls 12 and 14, respectively, are curved and extend towards each other to provide a roof for the vessel. The front wall 12 and the partition 16, along with corresponding portions of the sidewalls 18 and 20, form a furnace section 22.

The walls 12 and 14, the partition 16, and the sidewalls 18 and 20 are each formed by a plurality of vertically-disposed tubes 23 (FIG. 1) interconnected by vertically-disposed elongated bars, or fins to form a contiguous, airtight structure. Since this type of structure is conventional, it will not be described in further detail.

Conventional flow circuitry is provided, although not shown, to pass water, steam and/or a water-steam mixture (hereinafter termed "fluid") through the tubes 23 to heat the fluid to the extent that it can be used to perform work, such as driving a steam turbine. To this end, headers (not shown) are connected to the upper and lower ends of the walls 12 and 14 for introducing fluid to, and receiving fluid from, the tubes 23 forming the respective walls. Downcomers connect a steam drum (not shown) to the headers by branch conduits for passing fluid from the drum to the headers. Conduits (not shown) connect the upper headers to the steam drum for returning fluid from the headers to the drum. The aforementioned flow circuitry is also provided for the partition 16 and the sidewalls 18 and 20, and it is understood that the reactor 10 may be equipped with additional flow circuitry for improving the transfer of heat from the reactor 10. Since, this type of flow circuitry is well known, it is not shown in the drawings nor will it be described in further detail.

A perforated air distribution plate 24 is suitably supported at a lower portion of the furnace section 22 and defines a plenum chamber 26 extending below the plate 24. Air from a suitable source is introduced into the plenum chamber 26 by conventional means, such as a forced-draft blower, or the like. The air introduced through the plenum chamber 26 passes in an upwardly direction through the air distribution plate 24 and may be preheated by air preheaters and appropriately regulated by air control dampers as needed.

The air distribution plate 26 is adapted to support a bed of particulate fuel material consisting, in general, of crushed coal and limestone, or dolomite. A fuel distributor pipe 27 (FIGS. 2 and 4) extends through the front wall 12 for introducing the particulate fuel into the furnace section 22, it being understood that other pipes can be associated with the walls 12, 18, and 20 for distributing particulate fuel material and/or additional particulate fuel material into the furnace section as needed. It is understood that a drain pipe may register with an opening in the air distribution plate 24 and extend through the plenum 26 for discharging spent fuel and sorbent material from the furnace section 22 to external equipment.

A horizontal cyclone separator, designated generally by the reference numeral 28, is provided in an upper portion of the vessel formed by the reactor 10. The separator 28 includes a horizontally-disposed vortex chamber 30 for separating solid particles from a mixture of gases and particles, in a manner to be described. The vortex chamber 30 is generally cylindrical and is defined by the upper, curved portions 12*a* and 14*a* of the front wall 12 and the rear wall 14, respectively, as well as an upper portion 16*a* of the partition 16 which is curved towards, and is connected to, the curved wall portion 12*a*. An elongated opening formed in the upper portion 16*a* of the partition 16 defines an inlet 32 extending a fraction of the length of the furnace section 22 and the vortex chamber 30. The vertical portions of the partition 16 and the wall 14 define an outlet trough 34 extending from a lower portion of the vortex chamber 30 to an area just above the distribution plate 24. The wall 14 and the partition 16 also include angularly extending straight portions 14*b* and 16*b*, respectively, which define a horizontally oriented funnel 35, extending the full length of the vortex chamber 30, for directing the separated solids from the vortex chamber 30 to the outlet trough 34.

A solid block 33 having ends 33*a* and 33*b* (FIG. 1); sides 33*c* and 33*d*; a top 33*e*; and a bottom 33*f* is disposed in the furnace section 22 and is mounted on the partition 16, with the side 33*d* and the top 33*e* of the block engaging the wall portions 16*b* and 16*a*, respectively, of the partition 16 as shown in FIGS. 2 and 4. The side 33*c* of the block 33 is positioned just below the inlet 32 and parallel to the wall 12 to define, along with the latter wall and the sidewall 20, a straight passage, having a substantially rectangular cross-section, registering with the inlet 32 to direct the flow of entrained solids and gases substantially tangential into the separator 28.

A central open-ended tube 36 extends through the sidewall 20 and has a first portion 36*a* extending just above the inlet 32 as viewed in FIG. 1, and a second portion 36*b* projecting outwardly from the latter wall.

A generally ring-shaped solids deflector 38 having an outer annular flange 39 (FIGS. 1 and 3) extends inwardly from wall 18 and is connected to the wall in any conventional manner. An opening, or slot, 38*a* is defined in the lower portion of the deflector 38 for directing separated solids into the funnel 35 and the outlet trough 34.

In operation, particulate fuel material is introduced to the air distribution plate 24 from the distributor pipe 27 and is ignited by a light-off burner (not shown), or the like. Additional material, such as adsorbent material, or the like, may be introduced through other distributors into the interior of the furnace section 22, if needed.

A high-pressure, high-velocity, combustion supporting air is introduced through the air distribution plate 24 from the plenum chamber 26 at a velocity which is greater than the free-fall velocity of the relatively fine particles in the bed and less than the free-fall velocity of relatively course particles. Thus, a portion of the fine particles become entrained and pneumatically transported by air and the combustion gases. The mixture of entrained particles and gases rises upwardly within the furnace section 22 and is directed by the block 33 and corresponding portions of the walls 12 and 20 through the inlet 32 and into the vortex chamber 30 in a direction substantially tangential to the vortex chamber 30 and thus swirls around in the chamber. The entrained solid particles are propelled by centrifugal forces against the inner surfaces of the upper portions 12*a*, 14*a*, and 16*a* of the walls 12 and 14 and the partition 16, respectively, forming the vortex chamber 30, where they collect and are thus separated from the gases. The separated particles then fall downwardly by gravity into the funnel 35 and the outlet trough 34. The partition 16 extends sufficiently into the fuel bed supported by the distribution plate 24 so that the particles can flow from the outlet trough 34 into the furnace section 22 as needed, while sealing against backflow of the high-pressure gases from the furnace section 22. The pressure changes created by the spiral flow force the separated gases concentrating along the central axis of the vortex chamber 30 toward the low pressure area created at the inlet opening of the tube 36. The clean gases thus pass into the tube 36 and exit through the outlet opening directly into a heat recovery section or other external equipment.

Water is introduced into the system through water feed pipes that are conducted downwardly through the tubes forming the walls 12, 14, 18, and 20 and the partition 16 as described above. Heat from the fluidized bed, the gas column, and the transported solids convert a portion of the water into steam, and the mixture of water and steam rises in the tubes, collects in a set of upper headers and is transferred to a steam drum. The steam and water are separated within the steam drum in a conventional manner and passed to conventional external equipment. Other cooling surfaces, preferably in the form of partition walls with essentially vertical tubes, can be utilized in the furnace section 22.

It is thus seen that the reactor of the present invention provides several advantages. For example, the provision of the horizontal cyclone separator integrated in the upper portion of the reactor 10, with the outlet trough 34 connected directly to the fuel bed of the furnace section 22, permits the separation of the entrained particles and the recycling of same back to the furnace section while eliminating the need for relatively bulky and expensive vertical cyclone separators. Also the gas-solids mixture enters the vortex chamber 30 generally tangentially through the inlet 32 extending along a fraction of the length of the furnace section, without being significantly redirected by unnecessary baffles, tubes and/or ducting. Also, the inlet 32 extends only a fraction of the length of the separator 28 thereby preventing separated solids within the vortex chamber 30 from encountering the incoming gas-solids mixture. Furthermore, the ring-shaped solids deflector 38 prevents solids from bouncing from the rear wall 18 into the exiting gas vortex spinning towards the gas exit 42. Moreover, the central tube 36 promotes well-defined circulation in the vortex chamber 30, thereby providing sufficient centrifugal force to counteract the reversal of acceleration caused by the earth's gravity. Finally, since the outer portion 36*b* of the tube 36 is provided just behind the end of the vortex chamber 30, the hot, clean gases are transferred directly and quickly into external equipment without the need for additional piping and intricate duct arrangements.

It is understood that variations in the foregoing can be made within the scope of the invention. For example, the walls of the vessel of the reactor 10 may be reconfigured to accommodate more than one horizontal cyclone separator in the upper portion thereof in communication with the furnace section. Also, while the headers and flow circuitry have been described, it should be understood that any other suitable header and flow circuitry arrangement could be employed in connection with the present invention.

A latitude of modification, change, and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. In a fluidized bed reactor having a vessel for receiving a fluidized bed of solid particles including fuel, and a cyclone separator formed in the upper portion of the vessel by extending the walls of the vessel in a manner to form two end walls and two opposed walls, at least one of the opposed walls having a curved portion defining a generally cylindrical vortex chamber, an inlet opening connecting the vessel to the vortex chamber for introducing a mixture of the particles and gases from the vessel into the vortex chamber where the fuel particles are separated from the gases by centrifugal forces, an outlet opening formed through one of the walls in communication with the vortex chamber for discharging the gases from the vortex chamber, and a passage connecting the vortex chamber to the fluidized bed to pass the separated particles back to the fluidized bed; wherein the improvement comprises:

a block disposed adjacent the inlet opening for defining an inlet passage for directing the mixture in into the vortex chamber in a tangential direction thereto.

2. The improvement of claim 1 wherein the inlet opening extends from the one end wall for a distance less than half the distance between the end walls.

3. The improvement of claim 1 wherein the passage is formed by a partition disposed between and substantially parallel to the two opposed walls and extending from the vortex chamber to the fluidized bed and from the one end wall to the other end wall.

4. The improvement of claim 1 further comprising an outlet tube having an end extending with the chamber for receiving the separated gases, the tube extending through the outlet opening for discharging the gases externally of the chamber.

5. The improvement of claim 1 wherein the inlet opening is formed through the curved wall portion and the block is disposed on the curved wall portion.

* * * * *

UNITED STATES PATENT AND TRADEMARK OFFICE

CERTIFICATE OF CORRECTION

PATENT NO. : 6,245,300 B1
DATED : June 12, 2001
INVENTOR(S) : Juan Antonio Garcia-Mallol It is certified that error appears in the above-identified patent and that said Letters Patent is hereby corrected as shown below:

Column 1,
Line 17, replace "starpipe." with -- standpipe. --

Signed and Sealed this

Ninth Day of April, 2002

*Attest:*

*Attesting Officer*

JAMES E. ROGAN
*Director of the United States Patent and Trademark Office*